US005114258A

United States Patent [19]

Yasunaga

[11] Patent Number: 5,114,258

[45] Date of Patent: May 19, 1992

[54] CAP WITH AIR PASSAGE

[75] Inventor: Masahiro Yasunaga, Osaka, Japan

[73] Assignee: Kabushiki Kaisha Sakura Kurepasu, Osaka, Japan

[21] Appl. No.: 690,938

[22] PCT Filed: Nov. 30, 1990

[86] PCT No.: PCT/JP90/01558

§ 371 Date: Jul. 10, 1991

§ 102(e) Date: Jul. 10, 1991

[87] PCT Pub. No.: WO91/08115

PCT Pub. Date: Jun. 13, 1991

[30] Foreign Application Priority Data

Dec. 1, 1989 [JP] Japan ..... 1-140049

[51] Int. Cl.[5] ..... B43K 9/00; B43K 25/00

[52] U.S. Cl. ..... 401/202; 24/11 R; 24/11 F; 24/11 M; 401/213; 401/243; 401/247

[58] Field of Search ..... 401/202, 213, 243, 247; 24/11 R, 11 F, 11 M, 11 P

[56] References Cited

U.S. PATENT DOCUMENTS 1,507,622 9/1924 Pilkington ..... 24/11 M

FOREIGN PATENT DOCUMENTS 3817248 10/1989 Fed. Rep. of Germany ..... 401/213

2218381 11/1989 United Kingdom ..... 401/243

*Primary Examiner*—Steven A. Bratlie

*Attorney, Agent, or Firm*—Jordan and Hamburg

[57] ABSTRACT

A cap includes a cap body and a clip attached to the cap body. The cap body has a small portion in a tip side thereof, and the sectional shape of the small portion is smaller than that of the adjacent portion. The clip has an annular mounting portion mounted on the outside of the small portion. An air passage is formed between the mounting portion and the small portion, and adapted for communicating a space before the tip side end with a space between the clip body and the cap body in a tail side portion of the cap. Alternately, a cap is formed with a first air passage between the mounting portion and the small portion for communicating a space before the tip end of the mounting portion and a space after the tail end of the mounting portion, a second air passage formed in the cap body for communicating a space before the cap body and a space after the cap body, the first air passage being connected to the second air passage.

6 Claims, 4 Drawing Sheets

CAP WITH AIR PASSAGE

BACKGROUND ART

The present invention relates to a cap which is to be attached to a tip portion of a writing implement, application implement or the like.

In general, a cap which is to be attached to a writing implement or the like is comparatively small in size. Accordingly, there is a likelihood that an infant mistakenly swallows the cap which in turn chokes the throat. If the throat should be completely blocked by the cap, the infant will probably be suffocated before a doctor arrives on the scene. Accordingly, it is extremely preferable that the cap has a structure in which a passage for respiration can be secured even if the infant swallows the cap by mistake.

As disclosed in Japanese Unexamined Patent Publication No. 1-157898, there has been provided a cap having an air passage formed in an outer periphery of the cap for rendering a tip side space of the cap communicate with a tail side space of the cap to secure a respiration passage.

With the above-mentioned cap, it is necessary to provide the air passage in the outer periphery of the cap. Consequently, the structure of the cap is complicated. In addition, there is a disadvantage that the diameter of the cap is unnecessarily large. In particular, in a case where a clip is attached to the cap with an annular body of the clip mounted on the outer periphery of the cap, the cap has a larger diameter, which consequently mars the appearance.

DISCLOSURE OF THE INVENTION

To solve the above-mentioned problems, the present invention employs the following structure.

A cap of the present invention comprises a cap body and a clip attached to the cap body, the cap body having a small portion in a tip side thereof, and the small portion having smaller sectional shape than an adjacent portion thereto, the clip having an annular mounting portion mounted on an outside of the small portion of the cap body, and an air passage for communicating a space before the tip side end of the cap with a space between the clip body and the cap body.

With this cap, a passage for respiration can be secured in case of emergency by the air passage formed between the small portion of the cap body and the mounting portion of the clip mounted on the outside of the cap body, and the space formed between the clip body and the cap body.

Also, a cap of the present invention comprises a cap body and a clip attached to the cap body, the cap body having a small portion in a tip side thereof and the small portion having smaller sectional shape than an adjacent portion thereto, the clip having an annular mounting portion mounted on an outside of the small portion of the cap body, a first air passage formed between the mounting portion and the small portion for communicating a space before a tip end of the mounting portion with a space after a tail end of the mounting portion, and a second air passage formed in the cap body for communicating a space before the cap body with a space after the cap body, the first air passage being connected to the second air passage.

With this cap, a passage for respiration can be secured in case of emergency by the first air passage formed between the small portion of the cap body and the mounting portion of the clip mounted on the outside of the cap body, and the second air passage formed in the cap body.

BRIEF DESCRIPTION OF THE DRAWINGS

FIG. 1 (*b*) is a side view showing the cap body;

FIG. 2 (*b*) is a side view showing the clip;

FIG. 3 (*b*) is a side view showing the cap;

FIG. 4 (*b*) is a side view showing the cap body;

FIG. 5 (*b*) is a side view showing the clip;

FIG. 6 (*b*) is a side view showing the cap;

FIG. 7 (*b*) is a side view showing the cap body;

FIG. 8 (*b*) is a side view showing the clip;

FIG. 9 (*b*) is a side view showing the cap;

FIG. 10 (*b*) is a side view showing the cap.

BEST MODE FOR EMBODYING THE INVENTION

Figure 2A:
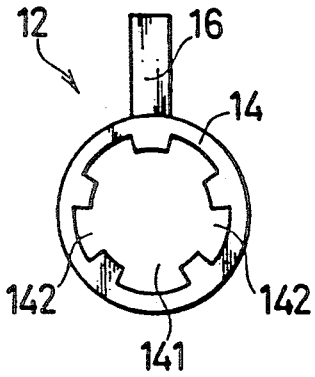
FIG. 2 (*a*) is a front view showing a clip for the cap body.
Figure 2B:
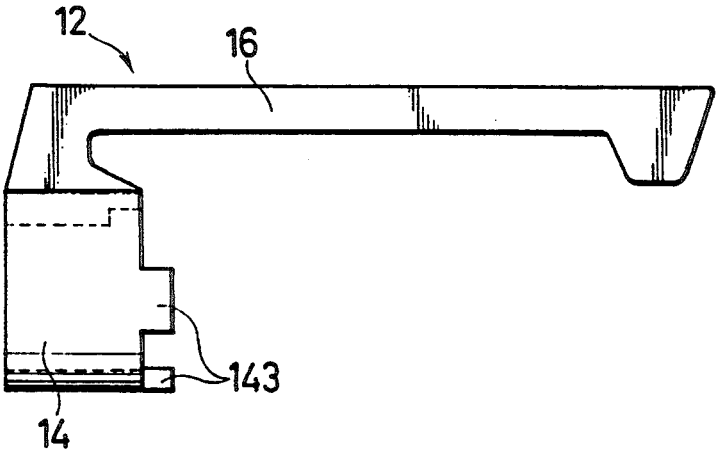
Figure 3A:
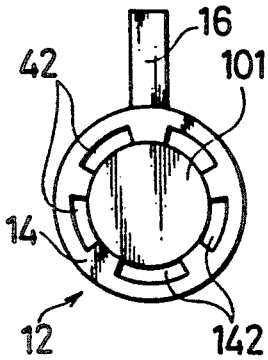
FIG. 3 (*a*) is a front view showing the cap.
Figure 3B:
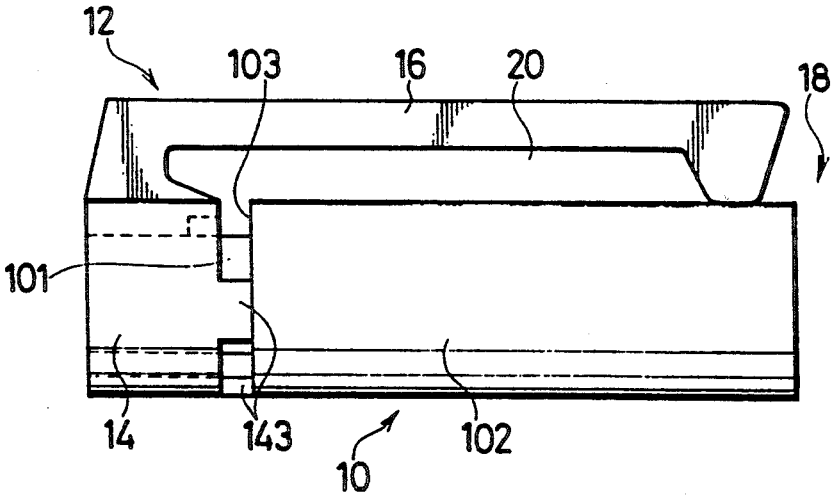

A first embodiment of the present invention will be described with reference to FIGS. 1 to 3.

Figure 1A:
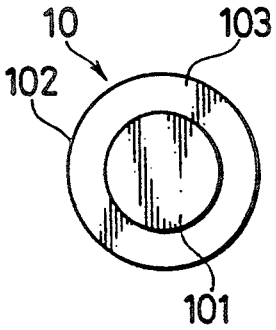
FIG. 1 (*a*) is a front view showing a cap body of a first embodiment of the present invention.
Figure 1B:
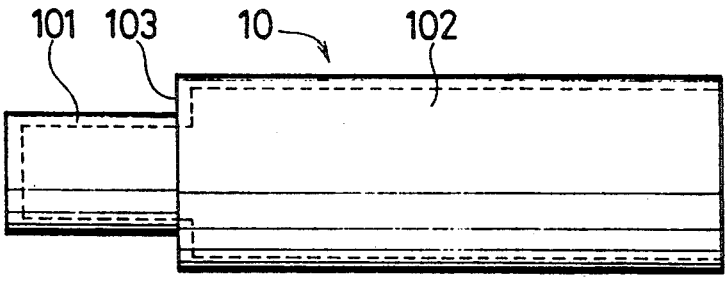

FIGS. 1 (*a*) and (*b*) show a cap body 10. FIGS. 2 (*a*) and (*b*) show a clip 12 which is to be attached to the cap body 10.

The cap body 10 has a hollow whose tail side end (right side in FIG. 1) is opened and whose tip side end is closed completely. The cap body 10 includes a small diameter portion 101 (small portion) formed in a tip side portion and a large diameter portion 102 having a larger diameter than that of the small diameter portion 101. A step 103 is formed between the small diameter portion 101 and the large diameter portion 102.

The clip 12 includes an annular mounting portion 14 and a clip body 16. The mounting portion 14 has a through hole 141. The clip body 16 extends from a portion of the outer periphery of the mounting portion 14 to a tail side end.

The mounting portion 14 has an inside diameter which substantially corresponds to an outside diameter of the small diameter portion 101 of the cap body 10. A plurality of grooves 142 are axially formed in the inner periphery of the mounting portion 14. A plurality of projections 143 are formed on the tail side end surface of the mounting portion 14. The mounting portion 14 is mounted on the outside of the small diameter portion 101. Consequently, a cap 18 is constructed as shown in FIGS. 3 (*a*) and (*b*).

With the cap 18 constructed above, the grooves 142 of the mounting portion 14 provide air passages between the mounting portion 14 and the small diameter portion 101 of the cap body 10. In addition, the projections 143 provide spaces between the tail side end surface of the mounting portion 14 and the step 103 of the cap body 10. Consequently, a space before the tip end of the cap 18 communicates with a space 20 between the clip body 16 and the cap body 10 in a tail side portion of the cap 18. Accordingly, even if an infant swallows the cap 18 by mistake, passages for respiration can be secured by the space 20 and the air passages.

Also, in this embodiment, an air passage is not formed in the cap body 10 as the conventional cap. Accordingly, the cap body 10 can be formed more easily. In addition, it is not necessary to increase the diameter of the cap body 10. Consequently, an improved appearance can be obtained.

Figure 4A:
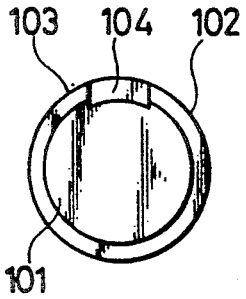
FIG. 4 (*a*) is a front view showing a cap body of a second embodiment of the present invention.
Figure 4B:
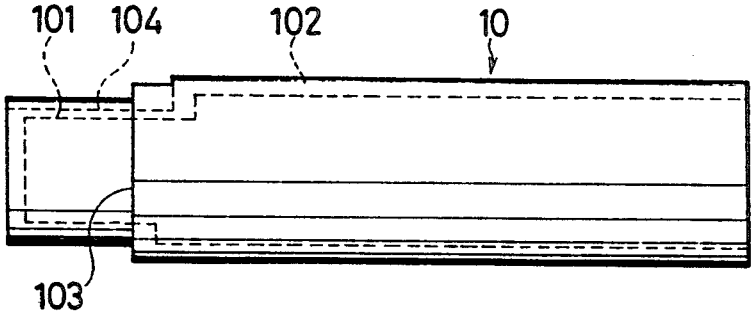

A second embodiment of the present invention will be described with reference to FIGS. 4 to 6.

Figure 5A:
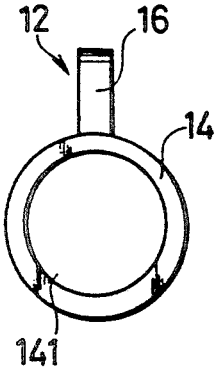
FIG. 5 (*a*) is a front view showing a clip for the cap body.
Figure 5B:
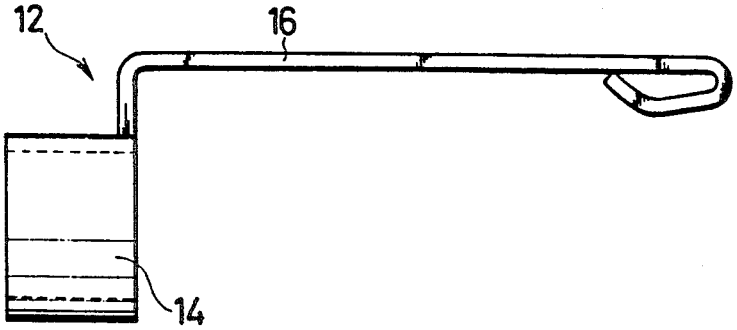

As shown in FIGS. 5 (*a*) and (*b*), a clip 12 has a mounting portion 14 in the form of a mere ring. As shown in FIGS. 4 (*a*) and (*b*), a cap body 10 has a groove 104 extending from a small diameter portion 101 to a tip side portion of a large diameter portion 102.

Figure 6A:
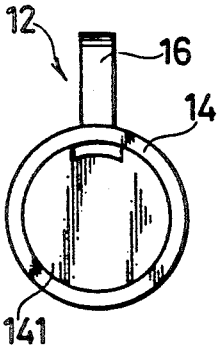
FIG. 6 (*a*) is a front view showing the cap.
Figure 6B:
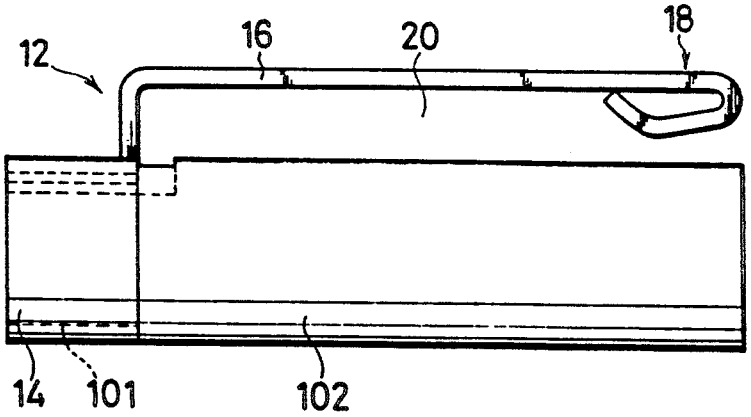

In this embodiment, as shown in FIGS. 6 (*a*) and (*b*), the mounting portion 14 of the clip 12 is mounted on the outside of the small diameter portion 101 of the cap body 10. Accordingly, the groove 104 provides an air passage, which consequently enable a space before the tip end of the cap 18 to communciate with a space 20 between the clip body 16 and the cap body 10 in a tail side portion of the cap 18. In this case, also, it is not necessary to form a passage in the cap body 10 and increase the diameter of the cap body 10.

A third embodiment of the present invention will be described with reference to FIGS. 7 to 9.

Figure 7A:
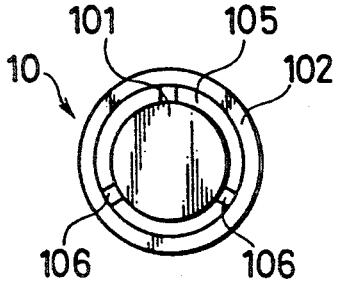
FIG. 7 (*a*) is a front view showing a cap body of a third embodiment of the present invention.
Figure 7B:
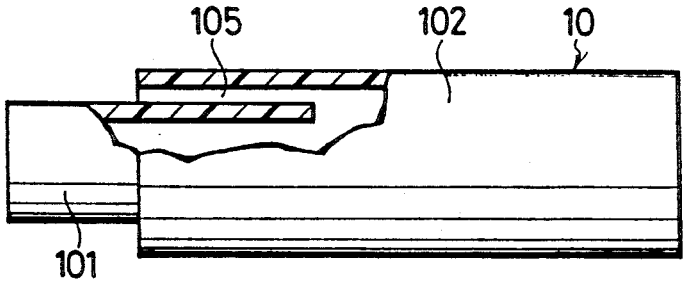
Figure 8A:
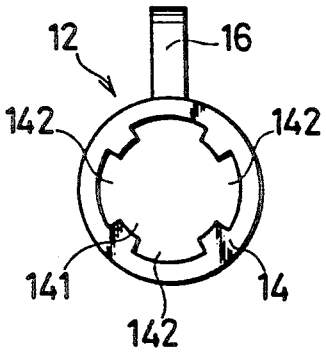
FIG. 8 (*a*) is a front view showing a clip for the cap body.
Figure 8B:
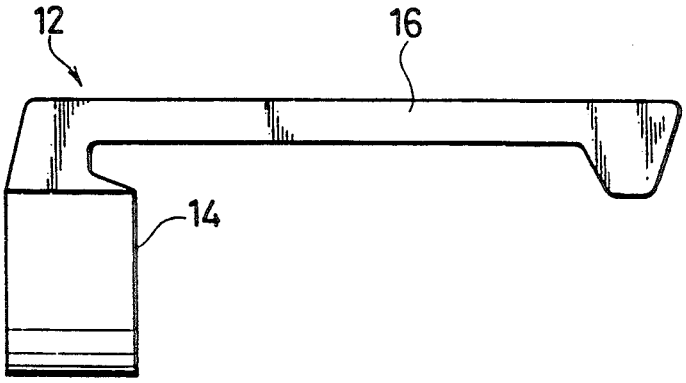

As shown in FIGS. 7 (*a*) and (*b*), a cap body has a gap (second air passage) 105 between a small diameter portion 101 and a large diameter portion 102. The small diameter portion 101 and the large portion 102 are connected to each other by means of ribs 106. The small diameter portion 101 is shaped into a small cap. The tip of a writing implement is to be inserted into the small diameter portion 101. As shown in FIGS. 8 (*a*) and (*b*), on the other hand, a mounting portion 14 of a clip 12 has a plurality of grooves 142 in similar to those shown in FIGS. 2 (*a*) and (*b*).

Figure 9A:
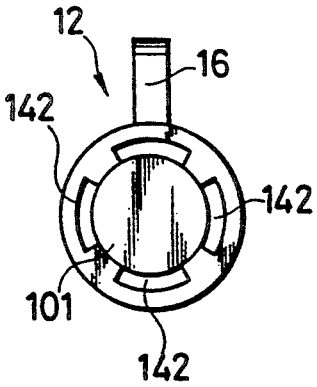
FIG. 9 (*a*) is a front view showing the cap.
Figure 9B:
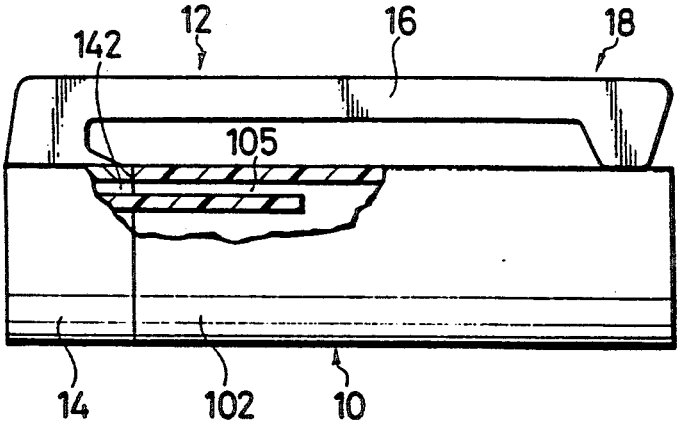

As shown in FIGS. 9 (*a*) and (*b*), the mounting portion 14 of the clip 12 is mounted on the outside of the small diameter portion 101 of the cap body 10. Accordingly, the grooves 142 provide first air passages and the gap 105 provides a second passage communicating with the first air passages, which thus secures a passage for respiration in case of emergency. In this case, also, a passage is secured between the mounting portion 14 and the small diameter portion 101. Consequently, it is not necessary to increase the diameter of the cap 18.

Figure 10B:
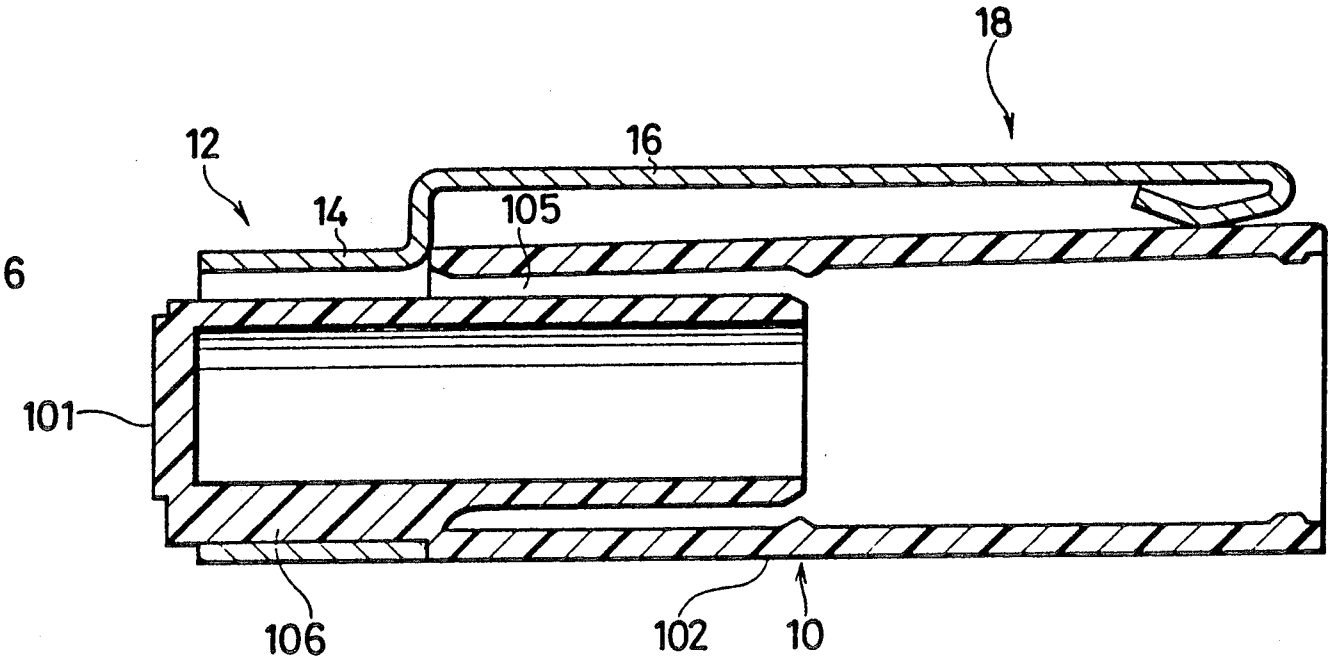
FIG. 10 (*a*) is a front view showing a cap of a fourth embodiment of the present invention.
Figure 10A:
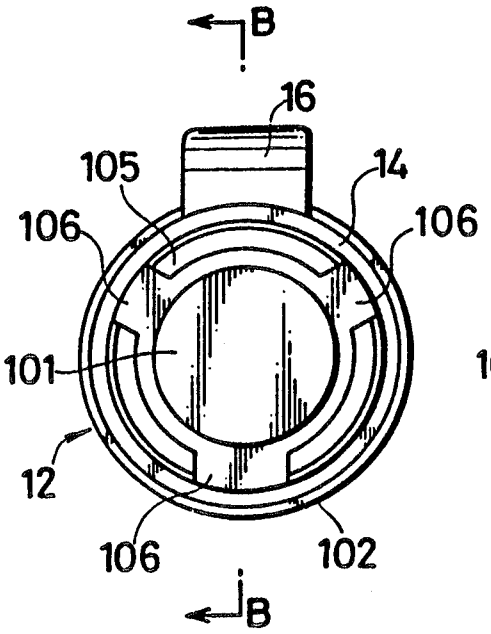

FIGS. 10 (*a*) and (*b*) show a fourth embodiment of the present invention. In this embodiment, a plurality of ribs 106 are formed on the outside of a small diameter portion 101 in the form of a cap into which the tip of a writing implement is to be inserted. An annular mounting portion 14 is directly mounted on outer surfaces of the ribs 106, so that first air passages are formed between the small diameter portion 101 and the mounting portion 14, and a second air passage is formed by a gap 105 between the small diameter portion 101 and the large diameter portion 102. Consequently, this embodiment can obtain the same effect as the third embodiment.

It should be noted that the present invention is not limited to the above-mentioned embodiments, and may adopt the following manners.

(1) According to the present invention, it is sufficient to make the mounting portion have a hollow. In addition to the hollow cylindrical mounting portions shown in the above-mentioned embodiments, a hollow polygonal, hollow elliptical, or other shaped mounting portion can be used. The shape of the small diameter portion is made to correspond to the shape of the above-mentioned mounting portions.

(2) According to the present invention, the shape of the clip and the cap body is not limited to the above-mentioned embodiments, and may be appropriately changed according to uses.

INDUSTRIAL AVAILABILITY

As described above, a cap of the present invention comprises a cap body and a clip attached to the cap body. In addition, the clip includes an annular mounting portion mounted on the outside of the cap body. An air passage is formed between the mounting portion and a small diameter portion of the cap body. Consequently, a passage for respiration can be secured in case of emergency. Furthermore, the shape of the cap body is not complicated and the diameter of the cap body is not increased. Accordingly, a cap with an improved appearance can be obtained.

What is claimed is:

1. A cap comprising a cap body and a clip attached to the cap body, the cap body having a small portion in a tip side thereof, and the small portion having smaller sectional shape that an adjacent portion thereto, the clip having an annular mounting portion mounted on an outside of the small portion of the cap body, and an air passage for communicating a space before the tip side end of the cap with a space between the clip body and the cap body.

2. A cap according to claim 1, wherein the mounting portion is formed with a groove in an inner periphery thereof and a projection on a tail side end surface thereof, the groove forming an air passage between the mounting portion and the small portion with the mounting portion mounted on the outside of the small portion, and the projection forming a clearance between the tail side end surface of the mounting portion and the cap body with the mounting portion mounted on the outside of the small portion.

3. A cap according to claim 1, wherein the cap body is formed with a groove from the small portion to a portion adjacent to the small portion, the groove forming an air passage between the small portion and the mounting portion with the mounting portion mounted on the outside of the small portion.

4. A cap comprising a cap body and a clip attached to the cap body, the cap body having a small portion in a tip side thereof and the small portion having smaller sectional shape than an adjacent portion thereto, the clip having an annular mounting portion mounted on an outside of the small portion of the cap body, a first air passage formed between the mounting portion and the small portion for communicating a space before a tip end of the mounting portion with a space after a tail end of the mounting portion, and a second air passage formed in the cap body for communicating a space before the cap body with a space after the cap body, the first air passage being connected to the second air passage.

5. A cap according to claim 4, wherein the second air passage is formed between the small portion and the other portion of the cap body, and the first air passage is formed between the small portion and a groove provided in the inner periphery of the mounting portion with the mounting portion mounted on the outside of the small portion.

6. A cap according to claim 4, wherein the second air passage is formed between the small portion and the other portion of the cap body, and the first air passage is formed between the mounting portion and a rib provided on the outer periphery of the small portion with the mounting portion mounted on the outside of the small portion.

* * * * *